US006645319B2

(12) United States Patent
Nagao et al.

(10) Patent No.: US 6,645,319 B2
(45) Date of Patent: Nov. 11, 2003

(54) WIRE ROD FOR DRAWING SUPERIOR IN TWISTING CHARACTERISTICS AND METHOD FOR PRODUCTION THEREOF

(75) Inventors: Mamoru Nagao, Kobe (JP); Kenji Ochiai, Kobe (JP); Nobuhiko Ibaraki, Kobe (JP); Takaaki Minamida, Kakogawa (JP); Hiroshi Yaguchi, Kobe (JP)

(73) Assignee: Kobe Steel Ltd., Kobe (JP)

( * ) Notice: Subject to any disclaimer, the term of this patent is extended or adjusted under 35 U.S.C. 154(b) by 3 days.

(21) Appl. No.: 09/971,700

(22) Filed: Oct. 9, 2001

(65) Prior Publication Data

US 2002/0084003 A1 Jul. 4, 2002

(30) Foreign Application Priority Data

Nov. 6, 2000 (JP) ..... 2000-338021

(51) Int. Cl.[7] ..... C21D 8/06; C22C 38/02; C22C 38/04

(52) U.S. Cl. ..... 148/330; 148/332; 148/333; 148/598; 148/599

(58) Field of Search ..... 148/320, 598, 148/595, 599, 330, 332, 333

(56) References Cited

U.S. PATENT DOCUMENTS

| | | | |
|---|---|---|---|
| 3,900,347 A | 8/1975 | Lorenzetti et al. | |
| 5,211,772 A | 5/1993 | Ashida et al. | |
| 5,575,866 A | 11/1996 | Minamida et al. | |
| 5,873,958 A | 2/1999 | Makii et al. | |

FOREIGN PATENT DOCUMENTS

| | | | | |
|---|---|---|---|---|
| JP | 63020419 A | * | 1/1988 | |
| JP | 05-302120 | | 11/1993 | |
| JP | 405295448 A | * | 11/1993 | ..... C21D/9/52 |
| JP | 405339676 A | * | 12/1993 | ..... C22C/38/00 |
| JP | 06-049592 | | 2/1994 | |
| JP | 406228642 A | * | 8/1994 | ..... C21D/8/06 |
| JP | 407179994 A | * | 7/1995 | ..... C22C/38/00 |
| JP | 08-283867 | | 10/1996 | |
| JP | 408283867 A | * | 10/1996 | ..... C21D/9/52 |
| JP | 11-199978 | | 7/1999 | |

* cited by examiner

*Primary Examiner*—Deborah Yee
(74) *Attorney, Agent, or Firm*—Oblon, Spivak, McClelland, Maier & Neustadt, P.C.

(57) ABSTRACT

A wire rod for drawing which is superior in drawability as well as twisting characteristics, and a method for producing the wire rod. The wire rod is characterized in that the raw material thereof is a eutectoid steel or hypereutectoid steel containing 0.1–2.0 mass % Si and 0.2–2.0 mass % Mn and the pearlite structure therein accounts for no less than 80 area % of microstructure and the maximum length of ferrite as the second phase therein is no larger than 10 $\mu$m. The wire rod is produced by drawing with a true strain of 1.5 or above and subjecting the wire rod to patenting at a heating temperature defined by a specific equation.

8 Claims, No Drawings

WIRE ROD FOR DRAWING SUPERIOR IN TWISTING CHARACTERISTICS AND METHOD FOR PRODUCTION THEREOF

BACKGROUND OF THE INVENTION

1. Field of the Invention

The present invention relates to a wire rod for drawing and a method for production thereof, said wire rod exhibiting good twisting characteristics when drawn into steel cord, wire saw, and steel wire for PC wire rope.

2. Description of the Related Arts

Hard drawn steel wire for steel cord and steel ropes is usually produced from wire rods by cold drawing which follows patenting. Drawing imparts strength to the steel wire. However, the resulting steel wire is subject to longitudinal cracking if it acquires an excessively high strength at the time of drawing. Therefore, wire rods for drawing are basically required to have good drawing characteristics.

The above-mentioned hard steel wire is examined for quality according to "Twisting Test" provided in Japanese Industrial Standards. It should meet requirements for the number of twists, the state of fracture, the uniformity of twist, and so forth, stipulated in the standard. (These requirements are referred to as "twisting characteristics" hereinafter.) One of the characteristics required of hard steel wire is resistance to longitudinal cracking called delamination.

It is common practice to use pearlite transformation in production of the above-mentioned steel wire. According to this method, wire rods undergo heating at a temperature (say, 900–1100° C.) above the $A_3$ transformation point for austenitic transformation (or γ-transformation), quenching and isothermal transformation (patenting) at 550–600° C. to give the pearlite structure, and cold drawing.

Wire rods to be drawn into steel wire are required to have good drawing characteristics as well as good twisting characteristics.

Japanese Patent Laid-open No. 302120/1993 intended to meet this requirement discloses a method of minimizing the network-like or thick cementite structure on the assumption that such cementite structure affects drawability. According to this disclosure, the object is achieved by subjecting the steel wire to austenitic transformation and performing patenting on the steel wire being drawn before or during transformation at a temperature below the $A_1$ transformation point.

This disclosure suggests that the resulting steel wire is free from delamination in the twisting test. In actual, however, the resulting steel wire is not so improved in twisting characteristics because the disclosed method is basically intended to improve drawability.

Also, Japanese Patent Laid-open No. 199978/1999 discloses a wire rod for drawing which is produced from the standpoint of improving twisting characteristics such that eutectoid steel or hyper-eutectoid steel has a ferrite particle diameter of 4.0 μm on average. The disclosed technology, however, does not meet the recent requirements for drawability and twisting characteristics.

OBJECT AND SUMMARY OF THE INVENTION

The present invention was completed in view of the foregoing. It is an object of the present invention to provide a wire rod for drawing superior in twisting characteristics as well as drawability and a method for production thereof.

The present invention is directed to a wire rod for drawing superior in twisting characteristics characterized in that the raw material thereof is a eutectoid steel or hyper-eutectoid steel containing 0.1–2.0 mass % Si and 0.2–2.0 mass % Mn and the pearlite structure therein accounts for no less than 80 area % of microstructure and the maximum length of ferrite as the second phase therein is no larger than 10 μm. The wire rod in a preferred embodiment is characterized in that the pearlite nodule therein is no larger than 20 μm in size.

The wire rod of the present invention is made of a eutectoid steel or hyper-eutectoid steel (with 0.65–1.2 mass % C) containing Si and Mn in specific amounts. It may optionally contain any one or more species selected from the following.

(a) less than 0.1 mass % Cu (0 mass % exclusive)

(b) no more than 0.8 mass % Cr (0 mass % exclusive)

(c) no more than 1 mass % Ni (0 mass % exclusive)

(d) 0.0003–0.005 mass % B (no less than 0.0003 mass % B in solid solution)

(e) no more than 0.1 mass % V (0 mass % exclusive), no more than 0.1 mass % Ti (0 mass % exclusive), no more than 0.1 mass % Nb (0 mass % exclusive), and no more than 0.1 mass % Mo (0 mass % exclusive).

The wire rod is improved differently in characteristic properties depending on the elements added.

The wire rod for drawing as specified in the present invention is produced by drawing with a true strain of 1.5 or above and patenting at a temperature (T° C.) defined by the equation (1) below.

$$354[C]+5.15[Cr]+1000[B]+600 \leq T \leq 354[C]+5.15[Cr]+1000[B]+620 \quad (1)$$

where, [C], [Cr], and [B] denote respectively the content (mass %) of C, Cr, and B.

DESCRIPTION OF THE PREFERRED EMBODIMENTS

In order to realize the wire rod for drawing which meets the above-mentioned requirements, the present inventors carried out extensive studies. As the result, it was found that the object is achieved if the wire rod is made of a eutectoid steel or hyper-eutectoid steel containing Si and Mn in specific amounts in which the pearlite structure accounts for no less than 80 area % of microstructure and the maximum length of ferrite as the second phase is no larger than 10 μm. This finding led to the present invention.

The present inventors continued their researches assuming that the twisting characteristics is affected by the maximum length of ferrite as the second phase. As the result, it was found that the major factor that controls the maximum length of ferrite is the grain size of austenite and the content of undissolved carbide resulting from insufficient heating in patenting. The undissolved carbide functions as ferrite nucleating sites and also prevents the growth of austenite crystal grains.

It is desirable to eliminate undissolved carbide almost completely from the view point of eliminating ferrite nucleating sites; however, a small amount of undissolved carbide is necessary to control the grain size of austenite. According to the present invention, the condition of patenting is established so as to control the grain size of austenite and the amount of undissolved carbide, thereby specifying the maximum length of ferrite. Thus it became possible to realize the wire rod for drawing which is superior in twisting characteristics.

Incidentally, it is suggested in Japanese Patent Laid-open No. 199978/1999 that the maximum grain size (or the length of major axis) of ferrite should desirably be no larger than 12 μm for prevention of longitudinal cracking. However, no concrete means is disclosed to achieve the object. What is intended for is to improve twisting characteristics by specifying the average grain size of ferrite instead of controlling and detecting the actual grain size of ferrite with difficulties. By contrast, the present invention makes it possible to keep the maximum length of ferrite no larger than 10 μm by specifying the composition and heat treatment conditions.

The maximum length of ferrite as the second phase implies the length of the major axis of the crystal grain of ferrite not having the pearlite structure. According to the present invention, the wire rod exhibits good twisting characteristics when the maximum length of ferrite is no larger than 10 μm. If the maximum length of ferrite exceeds 10 μm, the wire rod is poor in twisting characteristics and liable to longitudinal cracking called delamination.

The wired rod of the present invention contains the main phase of pearlite structure formed by patenting. The content of pearlite structure in the wire rod should be no less than 80 area %. Otherwise, the wire rod is poor in drawability due to increase in bainite structure. In addition, as is apparent from the foregoing, the wire rod of the present invention should desirably contain no ferrite. However, the effect of ferrite can be minimized by adequately controlling the grain size of ferrite.

Controlling the maximum length of ferrite as the second phase is as important as controlling the grain size of austenite. However, it is practically impossible to measure the grain size of austenite in the wire rod which has undergone patenting because the grain boundary of austenite disappears after patenting. In view of the fact that the grain size of austenite has a good correlation with the nodule size (or block size), it is possible to effectively control the grain size of austenite if the nodule size is kept no larger than 30 μm. In other words, ferrite as the second phase has the maximum length no larger than 10 μm if the nodule size is kept no larger than 30 μm.

According to the present invention, the raw material of the wire rod for drawing is a eutectoid steel or hypereutectoid steel containing 0.65–1.2 mass % C and other components (Si, Mn, etc.) in adequate amounts as explained in the following.

C: 0.65–1.2 mass %

This economical element is effective in increasing strength. Work hardening due to drawing and strength after drawing increase in proportion to the amount of C. Reduction of ferrite with a small amount of C is difficult to achieve. The wire rod of the present invention should be made of a eutectoid steel or hyper-eutectoid steel containing no less than 0.65 mass % C. However, an excessively large amount of C forms net-like cementite in the grain boundary of austenite, making the wire rod vulnerable to fracture at the time of drawing. Fine wires drawn from such a wire rod are considerably poor in toughness and ductility. Therefore, the maximum C content should be 1.2 mass %. The lower limit of C content should preferably be 0.7 mass %, more preferably 0.8 mass %. The upper limit of C content should preferably be 1.1 mass %.

Si: 0.1–2.0 mass %

This element functions as a deoxidizer. It plays an important role in the wire rod of the present invention which basically contains no Al which gives rise to alumina ($Al_2O_3$) inclusions which induce cuppy fracture. For Si to fully produce its effect, the Si content should be no less than 0.1 mass %. Si in an excess content hampers mechanical descaling (MD for short) in the drawing process. The upper limit of Si content should be 2.0 mass %, preferably 1 mass %, more preferably 0.5 mass %.

Mn: 0.2–2 mass %

Like Si, this element also functions as a deoxidizer. Effective deoxidation with Si and Mn is necessary for the wire rod of the present invention which is not positively incorporated with Al. For maximum effect, the Mn content should be no less than 0.2 mass %. However, the Mn content should be no more than 2.0 mass % because Mn is liable to segregation and excess Mn forms super-cooled structure (such as martensite and bainite) at segregated parts, thereby deteriorating drawability. The preferred lower limit of Mn content is 0.3 mass % and the preferred upper limit of Mn content is 1 mass %.

The wire rod for drawing of the present invention is basically composed of the above-mentioned components, with the remainder being substantially Fe. It may optionally contain one or more components selected from the following.

(a) less than 0.1 mass % Cu (0 mass % exclusive)

(b) no more than 0.8 mass % Cr (0 mass % exclusive)

(c) less than 1 mass % Ni (0 mass % exclusive)

(d) 0.0003–0.005 mass % B (no less than 0.0003 mass % B in solid solution) (e) no more than 0.1 mass % V (0 mass % exclusive), no more than 0.1 mass % Ti (0 mass % exclusive), no more than 0.1 mass % Nb (0 mass % exclusive), and no more than 0.1 mass % Mo (0 mass % exclusive).

Improvement in characteristics varies depending on the components added.

The content of optional components is specified for reasons given below. The wire rod of the present invention may contain trace amounts of additional components (such as P, S, As, Sb, and Sn as inevitable impurities) without adverse effects. The one containing such components is also within the scope of the present invention.

Cu: less than 0.1 mass % (0 mass % exclusive)

This element effectively increases the corrosion resistance of steel wires. It also improves scale peelability at the time of MD and prevents die seizure. For the maximum effect, the Cu content should be no less than 0.05 mass %. However, excess Cu causes blistering on the surface of the wire rod after hot rolling even when the hot rolled wire rod is held at a high temperature of about 900° C. Blistering forms magnetite in the steel matrix under blisters, and this magnetite hampers MD. In addition, Cu reacts with S to segregate CuS in the grain boundary. This segregation causes specks to the wire rod during its production. For the prevention of such adverse effect, the Cu content should be less than 0.1 mass %.

Cr: no more than 0.8 mass % (0 mass % exclusive)

This element reduces the lamellar intervals of pearlite, thereby improving the strength and drawability of the wire rod. For the maximum effect, the Cr content should be no less than 0.05 mass %. However, excess Cr forms undissolved cementite or prolongs the time required for transformation to complete. This forms super-cooled structure (such as martensite and bainite) in the hot-rolled wire rod and hampers MD. Therefore, the upper limit of Cr content should be no more than 0.8 mass %.

Ni: no more than 1 mass % (0 mass % exclusive)

This element improves the ductility of cementite and hence it contributes to drawability. It prevents hot cracking induced by Cu if it is added in an amount equal to or slightly less than Cu. The upper limit of Ni content should be no more than 1 mass % because Ni is expensive but does not contribute to strength so much.

B: 0.0003–0.005 mass % (no less than 0.0003 mass % B in solid solution)

This element prevents the formation of ferrite. It has been a general understanding that boron prevents ferrite formation because it segregates at grain boundaries in hypo-eutectoid steel, thereby lowering the grain boundary energy and decreasing the rate of ferrite formation, but boron does not produce its effect in eutectoid steel and hyper-eutectoid steel. However, it is known now that boron suppresses ferrite formation in eutectoid steel and hyper-eutectoid steel as well as hypo-eutectoid steel and effectively prevents longitudinal cracking. (See Japanese Patent Laid-open No. 356902/1999.) Boron to produce this effect in steel is present not in the form of compound but in the form of atom (called free boron) constituting solid solution. Boron in an amount less than 0.0003 mass % does not sufficiently produce the effect of preventing ferrite formation and longitudinal cracking. Boron in an amount more than 0.005 mass % forms such compound as $Fe_{23}(CB)_6$, which reduces the amount of free boron and hence lessens the effect of preventing longitudinal cracking. Moreover, $Fe_{23}(CB)_6$ usually appears as coarse grains which induce fracture at the time of drawing. The upper limit of B content should be 0.0003 mass %, preferably 0.0006 mass %, and the lower limit of B content should be 0.005 mass %, preferably 0.004 mass %. The amount of B dissolved in solid solution should be no less than 0.0003 mass %.

V: no more than 0.1 mass % (0 mass % exclusive)

Ti: no more than 0.1 mass % Ti (0 mass % exclusive)

Nb: no more than 0.1 mass % (0 mass % exclusive)

Mo: no more than 0.1 mass % (0 mass % exclusive)

These elements improve hardenability and contribute to high strength. However, if present excessively, they form carbides, thereby reducing the amount of carbon for lamellar cementite. This lowers strength or forms excess ferrite as the second phase. The upper limit of their content should be 0.1 mass %.

The wire rod mentioned above is produced by the method explained in the following. The method of the present invention starts with drawing with a true strain of 1.5 or above. This preliminary drawing permits ferrite to form solid solution rapidly at the time of patenting. Drawing is followed by heating for patenting. This heating permits cementite to form solid solution adequately before austenite crystal grains begin to grow rapidly. For this effect to be produced, it is necessary to introduce a true strain of 1.5 or above at the time of drawing. The upper limit of true strain is not specified, but it should preferably be lower than 3.0, more preferably lower than 2.5, so that the wire rod is drawn smoothly without fracture.

The above-mentioned drawing should be followed by patenting by heating at a temperature defined by the equation (1) above. Although the heating temperature for patenting is conventionally about 900–1100° C., the results of the present inventor's investigation revealed that it should be established with reference to the $A_{cm}$ line in the state diagram (the border line for cementite precipitation) if the dissolution and precipitation of undissolved carbides are to be properly controlled.

In other words, the equation (1) given above denotes the heating temperature based on the $A_{cm}$ line. Heating at a temperature defined by the equation (1) is effective in preventing anomalous growth of austenite grains and suppressing ferrite as the second phase nucleated by undissolved carbides. Patenting at a temperature lower than that defined in the equation (1) produces an adverse effect on twisting characteristics because of increase in the amount of undissolved carbides. On the other hand, patenting at a temperature higher than that defined in the equation (1) causes anomalous growth of austenite, giving rise to ferrite as the second phase larger than 10 $\mu$m in grain size. Incidentally, the equation (1) is generally applicable to the wire rod regardless of whether it contains boron or not. If the wire rod contains Cr and B (in which case the $A_{cm}$ line slightly rises), the equation (1) has 5.15[Cr] and 1000[B] as additional parameters.

EXAMPLES

The invention will be described in more detail with reference to the following examples, which are not intended to restrict the scope thereof. Various changes and modifications may be made in the invention without departing from the spirit and scope thereof.

Example 1

Steel ingots (Nos. 1 to 10) having chemical compositions shown in Table 1 were prepared. Each ingot was hot-rolled into a steel wire rod, 5.5 mm in diameter. This wire rod was made into a thinner wire rod (2.6 mm in diameter) by dry drawing and intermediate patenting. The resulting wire rod underwent secondary drawing with a true strain of 1.542 so that the diameter was reduced to 1.2 mm. This drawing was followed by patenting at varied temperatures (800° C., 900° C., 925° C., and 950° C.). Thus there were obtained the desired samples of wire rods for drawing.

TABLE 1

| | Chemical composition (mass %) | | | | | | Temperature |
|---|---|---|---|---|---|---|---|
| Steel No. | C | Si | Mn | B | B in solid solution | Others | (° C.) defined by equation (1) |
| 1 | 0.77 | 1.45 | 0.95 | — | — | — | 873–893 |
| 2 | 0.80 | 0.01 | 0.05 | — | — | — | 883–903 |
| 3 | 0.80 | 0.20 | 0.40 | — | — | Ni : 0.3 | 883–903 |
| 4 | 0.82 | 0.20 | 0.50 | — | — | — | 890–910 |
| 5 | 0.82 | 0.20 | 0.50 | — | — | Cu : 0.06 | 890–910 |
| 6 | 0.82 | 0.20 | 0.50 | — | — | Cu : 0.18 | 890–910 |
| 7 | 0.90 | 0.30 | 0.55 | — | — | Nb : 0.08 | 919–939 |
| 8 | 0.90 | 0.20 | 0.44 | — | — | Cu : 0.08<br>V : 0.03 | 919–939 |
| 9 | 0.98 | 0.16 | 0.38 | — | — | Cr : 0.18 | 948–968 |
| 10 | 0.97 | 0.21 | 0.41 | 0.0028 | 0.0020 | Cr : 0.19<br>Nb : 0.03 | 944–964 |

The wire rods for drawing obtained as mentioned above were examined for the size of the second phase ferrite and the nodule size in the following manner.

Measurement of the Size of the Second Phase Ferrite

The cross section of the wire rod (which has undergone patenting) is observed under a scanning electron microscope (1000 magnifications). Observation were performed at four intersections of mutually perpendicular diameters and a circle of half a diameter. The resulting electron micrograph is examined by an image analyzer for the maximum length of ferrite structure at each spot of observation.

Measurement of the Nodule Size

The nodule size is measured by observing the cross section of the wire rod which has been treated with nital etching solution in the usual way. The nodule size number G is obtained by the cutting method according to JIS G0552, and then it is converted into nodule size d by the formula d ($\mu$m)=$254/2^{(G-1)/2}$.

The wire rod obtained as mentioned above was finally drawn into a steel wire, 0.2 mm in diameter. The steel wire was tested for twisting characteristics, with the gauge length being 40 mm. The number of twists required to break the steel wire was counted, and the state of fracture was observed. Any sample is regarded as acceptable if it breaks in normal way without delamination after twisting more than 30 times. The results are shown in Table 2. (The symbol "x" in Tables 2 and 4 denotes those samples which experienced normal fracture and the symbol "○" in Tables 2 and 4 denotes those samples which are acceptable.) In Table 2, the asterisked values are outside the scope of the present invention. The same shall apply in Tables 3 and 4.

TABLE 2

| Test No. | Steel No. | Patenting temperature (° C.) | Maximum ferrite size ($\mu$m) | Nodule size ($\mu$m) | Number of twists | State of fracture | Remarks |
|---|---|---|---|---|---|---|---|
| 1 | 1 | 880 | 5 | 32 | 30 | ○ | Working Examples |
| 2 | 2 | 900 | 8 | 28 | 38 | ○ | |
| 3 | 3 | 900 | 7 | 20 | 36 | ○ | |
| 4 | 4 | 900 | 9 | 22 | 38 | ○ | |
| 5 | 5 | 900 | 10 | 26 | 32 | ○ | |
| 6 | 6 | 900 | 8 | 22 | 34 | ○ | |
| 7 | 7 | 925 | 7 | 27 | 36 | ○ | |
| 8 | 8 | 925 | 5 | 21 | 38 | ○ | |
| 9 | 9 | 955 | 6 | 26 | 32 | ○ | |
| 10 | 10 | 955 | 3 | 29 | 32 | ○ | |
| 11 | 1 | 900* | 12* | 32* | 32 | × | Comparative Examples |
| 12 | 2 | 880* | 12* | 34* | 30 | × | |
| 13 | 3 | 950* | 15* | 33* | 28 | × | |
| 14 | 4 | 950* | 14* | 32* | 26 | × | |
| 15 | 5 | 950* | 16* | 31* | 24 | × | |
| 16 | 6 | 950* | 16* | 33* | 26 | × | |
| 17 | 7 | 900* | 15* | 38* | 22 | × | |
| 18 | 8 | 900* | 13* | 36* | 20 | × | |
| 19 | 9 | 930* | 17* | 35* | 16 | × | |
| 20 | 10 | 980* | 21* | 33* | 18 | × | |

It is apparent from Table 2 that the steel samples (in Nos. 1 to 10) which have undergone patenting at temperatures specified in the present invention have the ferrite size and nodule size specified in the present invention and gave steel wires (0.2 mm in diameter) superior in twisting characteristics. By contrast, the steel samples (in test Nos. 11 to 20) which have undergone patenting at temperatures outside the range specified in the present invention have the ferrite size and nodule size outside the range specified in the present invention and gave steel wires (0.2 mm in diameter) poor in twisting characteristics.

Example 2

This example demonstrates the effect of chemical composition on twisting characteristics. Steel ingots (Nos. 11 to 22) having chemical compositions shown in Table 3 were prepared. Each ingot was hot-rolled into a steel wire rod, 5.5 mm in diameter. This wire rod was made into a thinner wire rod (3.2 mm in diameter) by dry drawing and intermediate patenting. Some of the wire rods were made into thinner wire rods (2.0 mm in diameter) by additional drawing and patenting.

TABLE 3

| Steel No. | Chemical composition (mass %) C | Si | Mn | B | B in solid solution | Others | Temperature (° C.) defined by equation (1) |
|---|---|---|---|---|---|---|---|
| 11 | 1.35* | 0.30 | 0.50 | — | — | — | 1078–1098 |
| 12 | 0.85 | 1.5 | 0.50 | — | — | — | 901–921 |
| 13 | 0.85 | 2.1* | 0.50 | — | — | — | 901–921 |
| 14 | 0.90 | 1.20 | 1.0 | — | — | — | 919–939 |
| 15 | 0.90 | 1.20 | 2.1* | — | — | — | 919–939 |
| 16 | 0.90 | 1.20 | 0.40 | — | — | Cu : 0.05 | 919–939 |
| 17 | 0.98 | 0.20 | 0.40 | — | — | Cu : 0.6* | 947–967 |
| 18 | 0.98 | 0.20 | 0.40 | — | — | Cr : 1.1* | 953–973 |
| 19 | 1.00 | 0.20 | 0.40 | — | — | Nb : 0.11* | 954–974 |
| 20 | 1.00 | 0.20 | 0.35 | — | — | Ti : 0.3* | 954–974 |

TABLE 3-continued

| Steel No. | Chemical composition (mass %) C | Si | Mn | B | B in solid solution | Others | Temperature (° C.) defined by equation (1) |
|---|---|---|---|---|---|---|---|
| 21 | 0.80 | 0.22 | 0.36 | 0.0001* | 0 | — | 883–903 |
| 22 | 0.82 | 0.19 | 0.36 | 0.0052* | 0.0032 | — | 890–910 |

The resulting wire rods (3.2 mm and 2.0 mm in diameter) were made into thinner wire rods (1.2 mm in diameter) by drawing with a true strain of 1.96 and 1.02 and patenting at varied temperatures shown in Table 4. Thus there were obtained the desired samples of wire rods for drawing. The wire rod obtained as mentioned above was finally drawn into a steel wire, 0.2 mm in diameter. The steel wire was tested for twisting characteristics (the number of twists and the state of fracture) in the same way as in Example 1. The results are shown in Table 4.

TABLE 4

| Test No. | Steel No. | True strain | Patenting temperature (° C.) | Maximum ferrite size (μm) | Nodule size (μm) | Number of twists | State of fracture | Remarks |
|---|---|---|---|---|---|---|---|---|
| 21 | 11 | 1.96 | 840 | 18* | 42* | Not drawable to 0.2 mm | — | Comparative Example |
| 22 | 12 | 1.96 | 910 | 8 | 16 | 38 | ○ | Example |
| 23 | 12 | 1.02 | 910 | 13* | 16 | 32 | × | Comparative Example |
| 24 | 13 | 1.96 | 920 | 7 | 18 | Not drawable to 0.2 mm | — | Comparative Example |
| 25 | 14 | 1.02 | 920 | 15* | 17 | 21 | × | Comparative Example |
| 26 | 15 | 1.96 | 920 | 9 | 19 | 15* | × | Comparative Example |
| 27 | 16 | 1.96 | 920 | 3 | 14 | 36 | ○ | Example |
| 28 | 17 | 1.96 | 950 | 9 | 18 | Not drawable to 0.2 mm | — | Comparative Example |
| 29 | 18 | 1.96 | 960 | 16* | 32* | 16* | × | Comparative Example |
| 30 | 19 | 1.96 | 960 | 13* | 35* | 30 | × | Comparative Example |
| 31 | 20 | 1.96 | 960 | 6 | 10 | Not drawable to 0.2 mm | — | Comparative Example |
| 32 | 21 | 1.96 | 890 | 15* | 36* | 32 | × | Comparative Example |
| 33 | 22 | 1.96 | 900 | 8 | 14 | 32 | × | Comparative Example |

The following is noted from Table 4. The sample in test No. 21 cannot be drawn satisfactorily on account of excessive carbon content, whereas the sample in test No. 22 (which meets all the requirements of the present invention) can be drawn satisfactorily.

The samples in test Nos. 23 and 25 cannot be drawn satisfactorily on account of insufficient true strain before heating and hence excessive large ferrite size (13 μm, 15 μm).

The sample in test No. 24 cannot be drawn satisfactorily on account of excessive silicon content. The sample in test No. 26 gives a steel wire poor in twisting characteristics on account of excessive manganese content.

The sample in test No. 27 (meeting all the requirements of the present invention) exhibits good drawability, whereas the sample in test No. 28 is poor in drawability on account of excessive copper content.

The samples in test Nos. 29 to 33 (which have chemical compositions outside the range specified in the present invention) are poor in drawability or give steel wires poor in twisting characteristics.

[Effect of the Invention]

As mentioned above, the present invention provides a wire rod for drawing which is superior in drawability and gives steel wires superior in twisting characteristics. The present invention also provides a method for producing such a wire rod.

What is claimed is:

1. A wire or wire rod comprising a eutectoid steel or hypereutectoid steel containing:

0.1–2.0 mass % Si and 0.2–2.0 mass % Mn, wherein the wire or wire rod has a microstructure comprising no less than 80 area % pearlite and, optionally, a second phase comprising ferrite;

the maximum length of the ferrite grains in the optional second phase is no larger than 10 μm; and the steel further contains 0.0003–0.005 mass % B and the amount of B in solid solution is no less than 0.0003 mass %.

2. The wire or wire rod as defined in claim 1, wherein the pearlite has a nodule size no larger than 30 μm.

3. The wire or wire rod as defined in claim 1, wherein the steel further contains no more than 0.1 mass % Cu (0 mass % exclusive).

4. The wire or wire rod as defined in claim 1, wherein the steel further contains no more than 0.8 mass % Cr (0 mass % exclusive).

5. The wire or wire rod as defined in claim 1, wherein the steel further contains no more than 1 mass % Ni (0 mass % exclusive).

6. The wire or wire rod as defined in claim 1, wherein the steel further contains one or more species selected from the group consisting of:

no more than 0.1 mass % V (0 mass % exclusive), no more than 0.1 mass % Ti (0 mass % exclusive), no more than 0.1 mass % Nb (0 mass % exclusive), and no more than 0.1 mass % Mo (0 mass % exclusive).

7. A method of producing the wire or wire rod of claim 1, the method comprising:

drawing a wire rod with a true strain of 1.5 or above; and subjecting the wire rod to patenting at a heating temperature defined by the following equation:

$$354(C)+5.15(Cr)+1000(B)+600 \leqq T \leqq 354(C)+5.15(Cr)+1000(B)+620 \quad (1)$$

where (C), (Cr) and (B) denote respectively the mass % in the wire rod of C, Cr and B.

8. The wire or wire rod as defined in claim 1, wherein the steel further contains 0.65–1.2 mass % C.

* * * * *